US009097423B2

(12) United States Patent
Kraus et al.

(10) Patent No.: US 9,097,423 B2
(45) Date of Patent: Aug. 4, 2015

(54) PORTABLE GAS TORCH SUITABLE FOR IGNITING A FLAME IN COMBUSTION EQUIPMENT

(75) Inventors: Kurt Kraus, Tulsa, OK (US); William Rosencutter, Tulsa, OK (US)

(73) Assignee: Honeywell International, Inc., Morristown, NJ (US)

( * ) Notice: Subject to any disclaimer, the term of this patent is extended or adjusted under 35 U.S.C. 154(b) by 1474 days.

(21) Appl. No.: 12/619,479

(22) Filed: Nov. 16, 2009

(65) Prior Publication Data

US 2011/0117508 A1 May 19, 2011

(51) Int. Cl.

| | |
|---|---|
| ***F23Q 7/12*** | (2006.01) |
| ***F23Q 13/04*** | (2006.01) |
| ***F23D 14/34*** | (2006.01) |
| ***F23D 14/52*** | (2006.01) |
| *F23Q 2/28* | (2006.01) |
| *F23Q 3/00* | (2006.01) |

(52) U.S. Cl.

CPC ..... *F23Q 13/04* (2013.01); *F23D 14/34* (2013.01); *F23D 14/52* (2013.01); *F23D 2900/00014* (2013.01); *F23Q 2/28* (2013.01); *F23Q 2/287* (2013.01); *F23Q 3/004* (2013.01)

(58) Field of Classification Search

CPC ..... F23Q 2/28; F23Q 2/287; F23Q 3/004
USPC ..... 431/254, 255, 258, 263, 264
See application file for complete search history.

(56) References Cited

U.S. PATENT DOCUMENTS

| | | | | |
|---|---|---|---|---|
| 3,894,273 A | | 7/1975 | Newport, Jr. et al. | |
| 3,905,755 A | * | 9/1975 | Aske | 431/344 |
| 3,915,623 A | | 10/1975 | Wormser | |
| 3,920,375 A | * | 11/1975 | Sanderson et al. | 431/78 |
| 4,023,351 A | | 5/1977 | Beyler et al. | |
| 4,188,182 A | | 2/1980 | Junak | |
| 4,565,522 A | | 1/1986 | Schwartz | |
| 4,854,855 A | | 8/1989 | Rajewski | |
| 5,195,885 A | * | 3/1993 | Medina | 431/25 |
| 5,267,849 A | | 12/1993 | Paciorek | |
| 5,588,299 A | | 12/1996 | DeFreitas | |
| 5,628,180 A | | 5/1997 | DeFreitas | |
| 5,938,226 A | | 8/1999 | Transchel | |
| 5,938,426 A | * | 8/1999 | McGehee | 431/202 |

(Continued)

OTHER PUBLICATIONS

Chentronics, "High Energy Ignition System," 2 pages, downloaded Sep. 29, 2009.
Chentronics, "SmartSpark, Revolutionary Technology Advancements," 2 pages, downloaded Sep. 29, 2009.
Chentronics, "High Energy Ignition Diagnostics," 5 pages, 2 pages, downloaded Sep. 29, 2009.

(Continued)

*Primary Examiner* — Kenneth Rinehart
*Assistant Examiner* — Gajanan M Prabhu

(57) ABSTRACT

A portable hand held torch for use in manually igniting a standing pilot flame, a main burner flame, or any other suitable flame. In an illustrative embodiment, the portable hand held torch may include a torch body having a torch tip such that when the torch is lit, the torch tip emits a flame. The torch tip may include a hollow tip body with a first end and a second opposing end. The hollow tip body may define an initial combustion chamber. A fuel source conduit may provide fuel to the initial combustion chamber, and a high energy capacitive discharge igniter may provide a reliable ignition spark upon demand. The high energy capacitive discharge igniter may extend into the initial combustion chamber and be held in a fixed position relative to the fuel source conduit to help ensure consistent and reliable ignition, even in severe industrial environments.

11 Claims, 10 Drawing Sheets

(56) References Cited

U.S. PATENT DOCUMENTS

| | | | | |
|---|---|---|---|---|
| 6,104,143 | A | 8/2000 | Bonavia | |
| 7,905,236 | B2 * | 3/2011 | Bryman et al. | 131/351 |
| 2002/0064744 | A1 * | 5/2002 | Tse | 431/344 |
| 2003/0044741 | A1 | 3/2003 | McGehee | |
| 2010/0183993 | A1 * | 7/2010 | McAlister | 431/254 |

OTHER PUBLICATIONS

Chentronics, "Direct High Energy Ignition of Heavy Fuel Oil," 2 pages, downloaded Sep. 29, 2009.

http://chentronics,com/Motivator.html., "The Motivator—Hand Held High Energy Ignition," 1 pages, downloaded Sep. 29, 2009.

* cited by examiner

PORTABLE GAS TORCH SUITABLE FOR IGNITING A FLAME IN COMBUSTION EQUIPMENT

TECHNICAL FIELD

The disclosure relates generally to portable hand held torches. More particularly, the disclosure relates to portable hand held torches that are suitable for manually igniting a standing pilot flame, a main burner flame, or any other suitable flame in combustion equipment.

BACKGROUND

Portable gas torches are commonly used to light standing pilots and burner main flames in industrial, petrochemical and other burner or combustion applications. In such applications, the gas flame of the portable gas torches often becomes extinguished because of surrounding winds, relatively high velocity or high pressure air streams within the burners themselves, and/or other conditions that can quench or blow out the torch's flame. This then requires that the user relight the flame of the portable gas touch, which can be tedious and time consuming. What would be desirable is a portable hand held torch that has a more reliable flame under such harsh conditions, and/or that can be more easily and/or consistently relit under such harsh conditions.

SUMMARY

The disclosure is directed to a portable hand held torch for use in, for example, manually igniting a standing pilot flame, a main burner flame, or any other suitable flame in combustion equipment. In an illustrative embodiment, the portable hand held torch may include a torch body having a torch tip such that when the torch is lit, the torch tip emits a flame. The torch tip may include a hollow tip body with a first end and a second opposing end. The hollow tip body may define an internal volume that extends to the second end of the tip body. The portable hand held torch may further include a back plate positioned adjacent to the first end of the tip body and a flame locking plate positioned in the internal volume of the hollow tip body. The flame locking plate may be spaced a distance away from the back plate toward the second end of the tip body. The hollow tip body, back plate and the flame locking plate may generally define an initial combustion chamber. The portable hand held torch may further include a fuel source conduit for delivering a fuel to the initial combustion chamber and a high energy capacitive discharge igniter for creating a reliable ignition spark upon demand. The high energy capacitive discharge igniter may extend into the initial combustion chamber and be held in a fixed position relative to the fuel source conduit.

The above summary of some example embodiments is not intended to describe each disclosed embodiment or every implementation of the invention.

BRIEF DESCRIPTION OF THE DRAWINGS

The invention may be more completely understood in consideration of the following description of various embodiments in connection with the accompanying drawings, in which.

Figure 1:
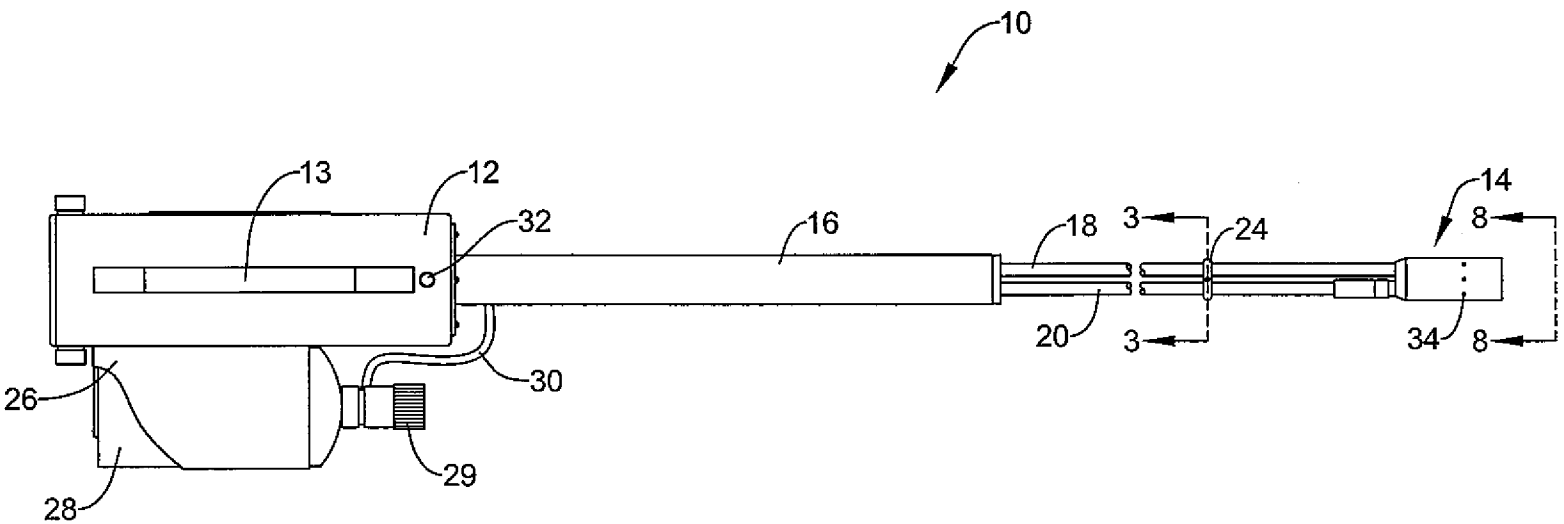
FIG. 1 is a top view of an illustrative hand held torch.

While the invention is amenable to various modifications and alternative forms, specifics thereof have been shown by way of example in the drawings and will be described in detail. It should be understood, however, that the intention is not to limit aspects of the invention to the particular illustrative embodiments described. On the contrary, the intention is to cover all modifications, equivalents, and alternatives falling within the spirit and scope of the invention.

DESCRIPTION

The following description should be read with reference to the drawings in which similar elements in different drawings are numbered the same. The description and the drawings, which are not necessarily to scale, depict illustrative embodiments and are not intended to limit the scope of the invention. The illustrative embodiments depicted are intended only as exemplary. Selected features of any particular illustrative embodiment may be incorporated into other illustrative embodiments or into an additional embodiment unless clearly stated to the contrary.

FIG. 1 provides a top view of an illustrative, but non-limiting, portable hand held torch 10 for use in, for example, manually igniting a standing pilot flame, a main burner flame, or any other suitable flame in combustion equipment. Hand held torch 10 may include a high energy igniter, such as a high energy capacitive igniter. Hand held torch 10 may further include a small gas nozzle or premix burner for the mixture of gaseous fuel and air in the proper proportion. The portable high energy igniter is held relative to a small gas burner such that the resulting spark of the high energy igniter is properly positioned relative to the small gas burner to help ensure consistent and reliable lighting of the gas torch in severe industrial environments. In some cases, the high energy igniter is positioned adjacent to the gas source in an initial combustion chamber of the portable hand held torch 10.

The defined initial combustion chamber may help maintain the flame of the portable hand held torch 10 despite the presence of winds, relatively high velocity or high pressure differential air stream(s), or other conditions in or around the portable hand held torch 10. However, even if the flame were to be extinguished by such conditions, the gas torch 10 can reliably, quickly, and easily be relit by the associated high energy igniter. In some cases, the high energy igniter may be capable of emitting a spark in extreme and/or unusual conditions. For example, the high energy igniter may be capable of emitting a spark under water, in oil, in air, and/or in other unusual conditions. One such high energy igniter is made by Chentronics, located in Norwich, N.Y.

Hand held torch 10 may include a body 12 at a first end and a torch tip body 14 at a second opposing end. A fuel conduit 18 and a high energy capacitive igniter tube 20 may extend between the body 12 and the torch tip body 14. Fuel conduit 18 may supply fuel from a fuel source 28 to torch tip 14. In some embodiments, fuel conduit and igniter tube 20 may be secured to body 12 at a first end, and to torch tip 14 at a second end. A portion of the length of fuel conduit 18 and igniter tube 20 may be enclosed within an additional tubular member 16, but this is not required. When provided, it is contemplated that tubular member 16 may be secured to body 12 by any suitable method, such as, but not limited to, welding, soldering, brazing, adhesive, bolting, etc. Alternatively, tubular member 16 may, when provided, be formed of a unitary structure with body 12. In some embodiments, it may be desirable to maintain the orientation of fuel conduit 18 and igniter tube 20 relative to one another such that fuel conduit 18 and igniter tube 20 may be spaced a distance from one another. When so provided, a bracket 24 (shown in more detail in FIG. 3) may be used to maintain fuel conduit 18 and igniter tube 20 in the proper orientation.

Fuel conduit 18 may be connected to a fuel source 28 by a fuel source conduit 30. Fuel source 28 may supply any suitable combustible fuel to the torch tip 14, such as, but not limited to, propane, butane, natural gas, or any other suitable fuel source. In some instances, the fuel source 28 may be a remotely located vessel, domestic or industrial pipeline source connected by a fuel conduit 18 of extended length. In some cases, fuel source 28 may include a valve 29 that may be opened when the hand held torch 10 is in use and closed when the hand held torch 10 is no longer in use. It is contemplated that in some embodiments the hand held torch may include a series of valves 29. Valve 29 may include any appropriate mechanism for controlling the flow of fuel to the tip 14. For example, in some instances fuel may be supplied to the fuel source conduit 30 at a pressure between 0.5 and 25 pounds-force per square inch gauge (psig). It is contemplated that fuel may be supplied at a pressure less than 0.5 psig or greater than 25 psig depending on the application. In some cases, fuel source 28 may be connected to the body 12 of hand held torch 10 by a bracket 26 or other suitable mounting mechanism. It is contemplated that in some embodiments, bracket 26 may be integrally formed with body 12. In other embodiments, and when provided, bracket 26 may be removably attached to the body 12 by any desired mechanism, such as, but not limited to, screw, bolts, releasable clamp, etc. Body 12 may further include a handle 13 for transporting and handling the hand held torch 10 during use.

Figure 2:
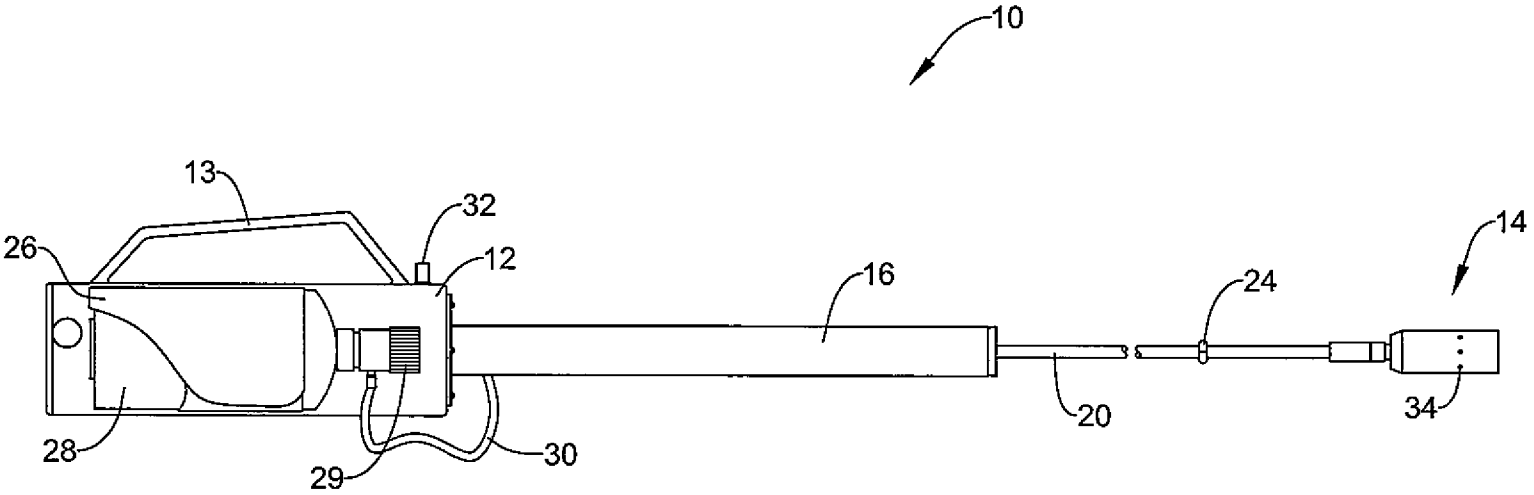
FIG. 2 is a side view of the illustrative hand held torch of FIG. 1.

FIG. 2 shows a side view of the illustrative but non-limiting portable hand held torch 10 of FIG. 1. As can be seen more clearly in FIG. 2, the body 12 may further include one or more igniter buttons or switches 32. Igniter button or switch 32 may close an electrical switch that activates a high energy igniter, such as a high energy capacitive igniter, to provide a high energy spark (or series of high energy sparks) within torch tip 14. For example, a high energy igniter spark plug may be electrically powered by an electric power source that may be activated by igniter button and/or switch 32. In some instances, the electric power source may be a battery disposed within body 12. In other instances, the electric power source may be line voltage connected through a suitable cord (not shown).

In operation, a user may first take reasonable steps to be assured that the atmosphere and area surrounding the portable hand held torch 10 is safe for ignition, e.g., free of other combustible fuel and air stream mixtures. The user may then place the torch tip 14 in the vicinity of where the torch flame, once lit, is desired. The valve 29 on the fuel source may then be opened allowing fuel to travel from the source 28 through the fuel source conduit 30 and the fuel conduit 18 to the torch tip 14. As soon as reasonably possible following the opening of the valve 29, the user may momentarily depress igniter button or switch 32 to activate a high energy spark at the torch tip 14. The high energy spark, which is held in proper alignment with the tip of the gas conduit, may ignite the fuel resulting in a flame at the torch tip 14. If the flame becomes extinguished by the affect of surrounding environmental conditions, the hand held torch 10 may be immediately relit by once again momentarily depressing igniter button or switch 32 to activate the high energy spark. When the desired task (e.g. igniting a standing pilot flame, a main burner flame, or the like, of combustion equipment) has been accomplished, the user may extinguish the flame by closing fuel valve 29.

Figure 3:
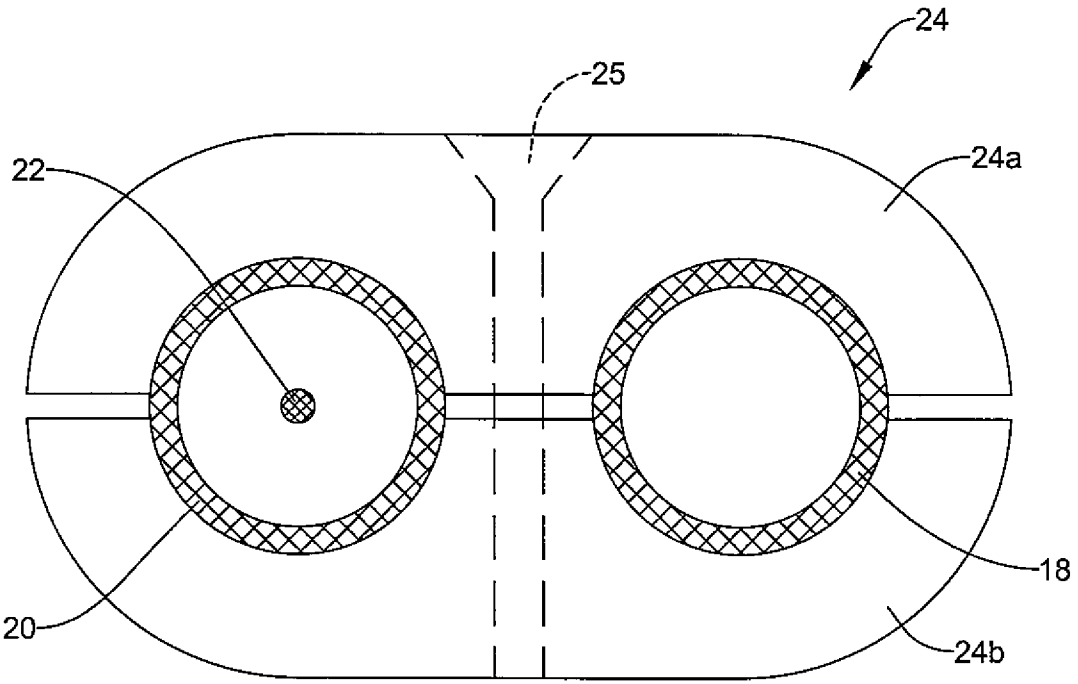
FIG. 3 is a cross-sectional view of the illustrative hand held torch of FIG. 1 taken along line 3-3.

FIG. 3 illustrates a cross-sectional view of bracket 24 disposed about fuel conduit 18 and igniter tube 20. As will be discussed in more detail with respect to FIGS. 4 and 5, an igniter wire(s) 22 connecting the electric power source (not shown) with a high energy igniter spark plug located in the torch tip 14, may be disposed within igniter tube 20. Bracket 24 may be configured to maintain a desired spacing between the fuel conduit 18 and the igniter tube 20, when desired. Bracket 24 may be formed from two separate bracket components 24*a*, 24*b* held together by a fastening device 25, e.g. a screw, bolt, or the like. Alternatively, bracket components 24*a*, 24*b* may be connected via a hinge or other suitable mechanism. It is contemplated that in some instances, the orientation of the fuel conduit 18 and igniter tube 20 may be maintained with a device other than a bracket 24.

Figure 4:
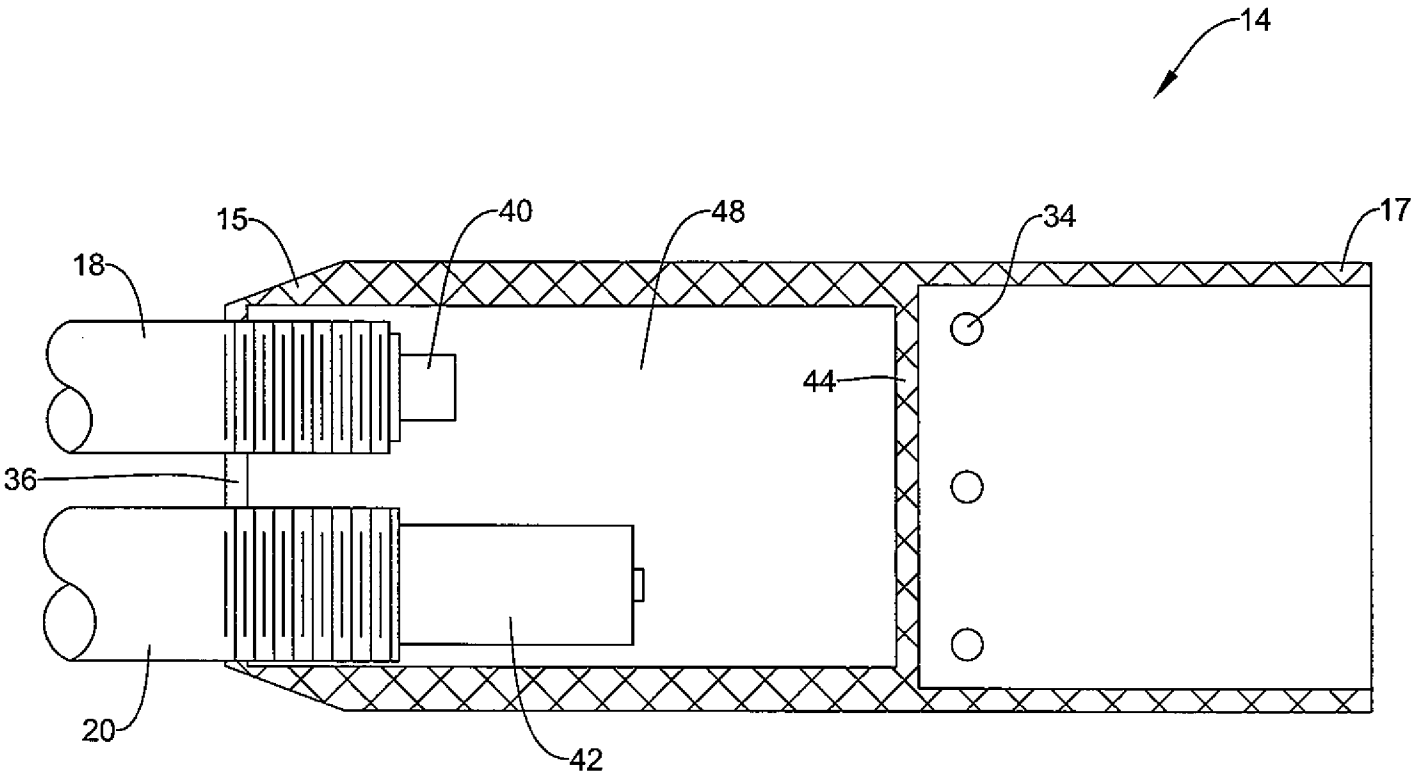
FIG. 4 is a partial cross-sectional view of a torch tip of the illustrative hand held torch of FIG. 1.

FIG. 4 illustrates a partial cross-section of torch tip body 14. In the illustrative embodiment, torch tip body 14 may include a generally hollow body having a first end 15 (positioned closest to body 12) and a second end 17. First end 15 may be configured to receive the fuel conduit 18 and the igniter conduit 20. Second end 17 may be configured to emit a flame. Fuel conduit 18 may include a fuel spud 40 disposed within a lumen of the conduit 18. While not expressly shown in FIG. 4, fuel spud 40 may include an aperture 56 (see FIG. 5) defined therethrough to allow fuel to flow into and enter the generally hollow body of fuel tip 14. The aperture 56 may be sized to allow a desired amount of fuel to exit fuel tube 18 into a combustion chamber 48 to create an optimal air to fuel ratio.

Figure 5:
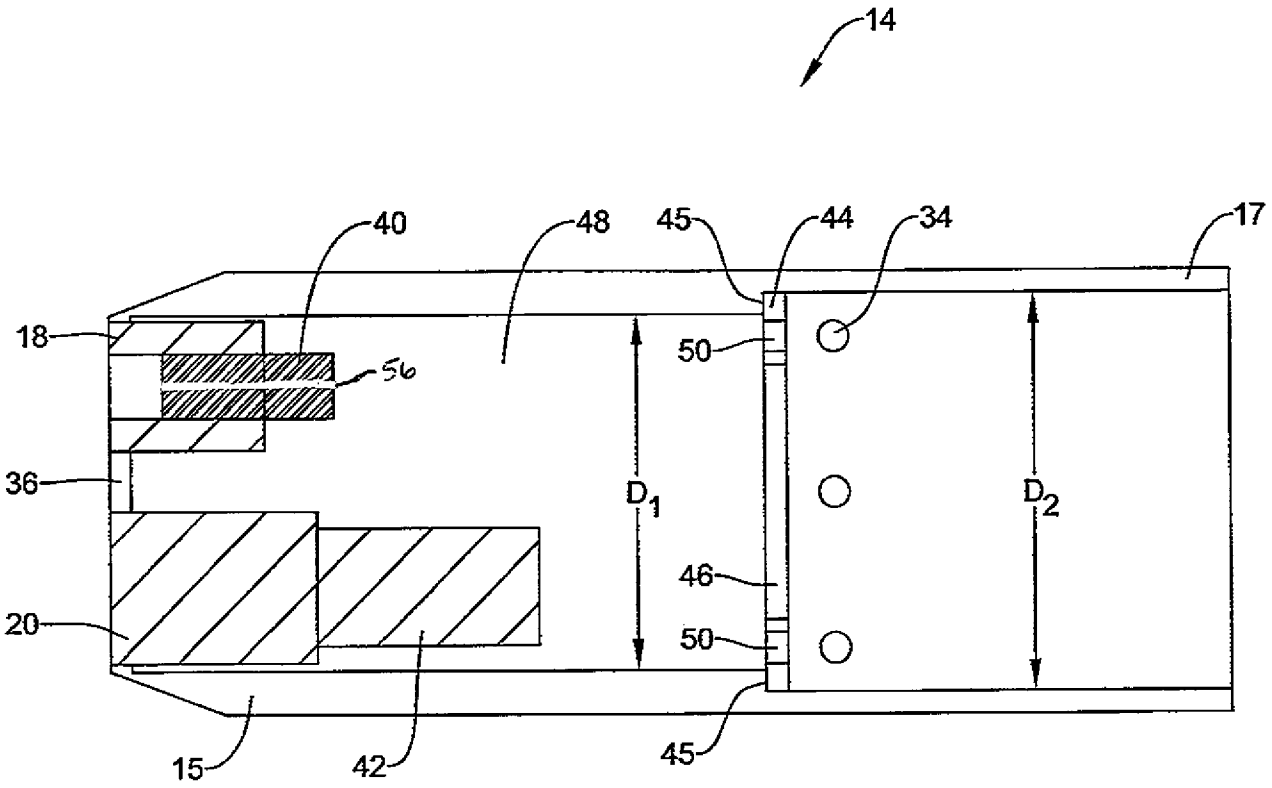
FIG. 5 is a cross-sectional view of a torch tip of the illustrative hand held torch of FIG. 1.

As can be seen in more detail with respect to FIG. 5, an initial combustion chamber 48 may be defined by the volume bounded by a back plate 36 (see FIG. 6) positioned adjacent the first end 15 of the tip 14, a flame locking plate 44 positioned within the internal volume of tip 14, and the walls of torch tip 14. Combustion chamber 48 may act as an ignition space for high energy igniter spark plug 42 to ignite the fuel provided through fuel spud 40, while protected from wind or other environmental elements that may otherwise prevent fuel from igniting and/or extinguish a flame.

Fuel conduit 18 may enter torch tip 14 at first end 15 and extend a distance into combustion chamber 48. Igniter tube 20 may also enter torch tip 14 at first end 15 and extend a second distance into the initial combustion chamber 48. In some embodiments, igniter tube 20 may extend further into the initial combustion chamber 48 than fuel conduit 18. Igniter conduit 18 may be positioned and secured relative to the fuel spud 40 such that the high energy igniter spark plug 42 will ignite the fuel air mixture within the combustion chamber 48 largely independent of the composition, temperature, flow velocity, or direction of surrounding ambient or ducted air streams because the spark/and or fuel is protected from these conditions.

Torch tip 14 may further include radial spaced holes 34 extending from the outside surface of tip 14 to the internal volume of tip 14 to allow the flame to exit the side of the tip.

In the illustrative embodiment, the radial spaced holes 34 may be positioned between flame locking plate 44 and the second end 17 of torch tip 14, but this is not required. While torch tip 14 is illustrated as having three radial holes 34, it is contemplated that torch tip may have any number of holes 34 as desired, for example, one, two, three, four, or more. In some instances, radial spaced holes 34 may extend around the entire perimeter of torch tip 14. In other instances, radial holes 34 may be present in only select locations of the of torch tip 14.

FIG. 5 shows a cross-sectional view of torch tip 14. In the illustrative embodiment, torch tip 14 may include a back plate 36 positioned adjacent the first end 15 of the torch tip 14. Back plate 36 may include apertures or holes (see FIG. 6) for receiving fuel conduit 18 and igniter tube 20. In some instances, fuel conduit 18 and igniter tube 20 may be releasably attached to back plate 36. For example, fuel tube 18 and igniter tube 20 may be threadably engaged with back plate 36. In other embodiments, fuel conduit 18 and igniter tube 20 may be permanently attached to back plate 36 via welding, soldering, brazing, or other suitable bonding mechanism. Back plate 36 may secure fuel conduit 18 and igniter tube 20 such that igniter tube 20 is located in a fixed orientation and spacing relative to fuel conduit 18 to help optimize ignition. In some instances, back plate 36 may be formed of a unitary structure with torch tip 14. In other instances, back plate 36 may be attached to torch tip 14 by any suitable way, such as, but not limited to welding, soldering, brazing, etc. Alternatively, or in addition, back plate 36 may be press-fit within the hollow body of the torch tip 14.

Figure 6:
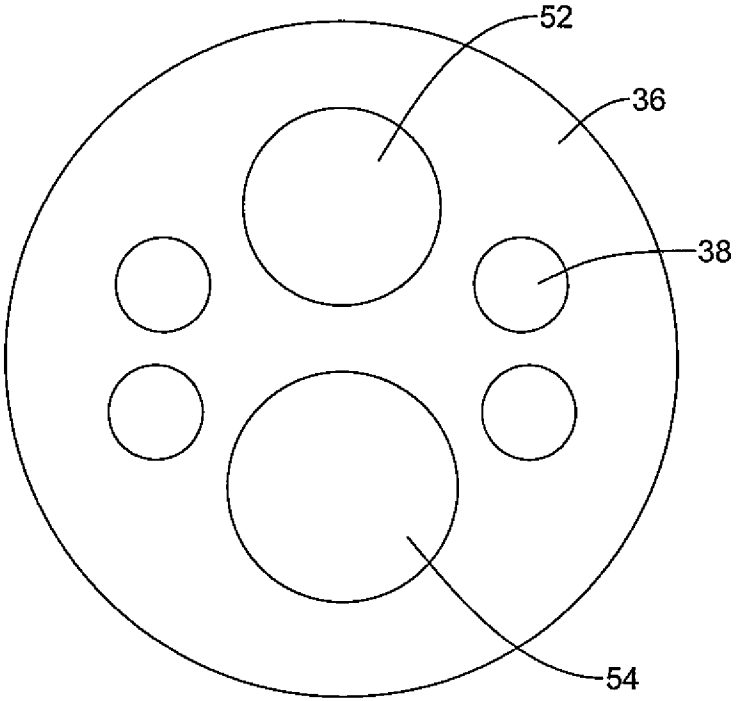
FIG. 6 is a cross-section of an illustrative back plate.

FIG. 6 provides an end view of an illustrative back plate 36 of FIG. 5 removed from the torch tip 14. For clarity, back plate 36 is illustrated without fuel tube 18 and igniter tube 20. Back plate 36 may include a first aperture 52 for receiving fuel tube 18 and a second aperture 54 for receiving igniter tube 20. While not expressly shown, apertures 52, 54 may includes features for securing fuel tube 18 and igniter tube 20 to the torch tip 14 such as, but not limited to, a threaded region. In some embodiments, back plate 36 may further include air holes 38 for allowing air to pass into the combustion chamber 48 to support combustion of the flame. Air holes 38 may be positioned, sized, and located in proper proximity to the fuel gas aperture in order to allow aspiration of air from the surrounding atmosphere in proper proportion to the fuel injected through the apertures thereby delivering the proper fuel and air mixture to the combustion chamber for reliable and repeatable ignition and continuous combustion. This arrangement may be considered to be a small naturally aspirated nozzle mix burner arrangement. While back plate 36 is shown as having four air holes 38, it is contemplated that back plate 36 may include any number of air holes as desired, such as, but not limited to, one, two, three, five, or more. It is further contemplated that the size and shape of the air holes 38 may take on any suitable configuration, based on the application. The quantity, size, and shape of the air holes 38 may be chosen to allow a desired amount of air into the combustion chamber 48 to create a desired air to fuel ratio. In some cases, the size and/or shape of the air holes 38 may be adjustable in the field.

Figure 5A:
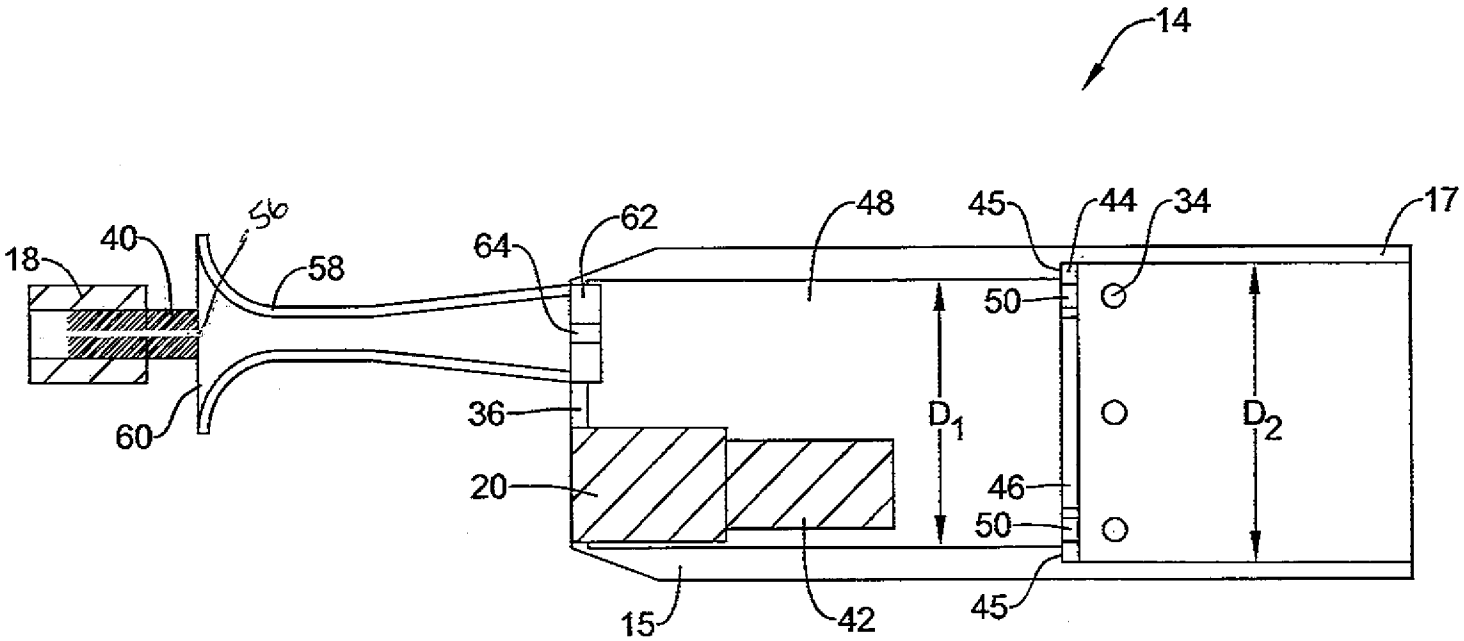
FIG. 5A is a cross-sectional view of an alternative torch tip configuration of the illustrative hand held torch of FIG. 1.

Referring to FIG. 5A, in an alternative embodiment, torch tip 14 may be configured to provide air and fuel premixed to the combustion chamber 48 in a small naturally aspirated premix burner arrangement. Instead of providing fuel directly to the combustion chamber 48, fuel conduit 18 and fuel spud 40 are shown connected to a venturi tube 58, which in turn may be connected to the back plate 36 of the torch tip 14 via venturi nozzle 62 and aperture 64, in place of aperture 52. While venturi nozzle 62 is illustrated as having one aperture 64, it is contemplated that venture nozzle 62 may have any number of apertures 64 as desired, for example, but not limited to, one, two, three, four, or more. In some instances, venturi tube 58 may be releasably attached to back plate 36. For example, venturi tube 58 may be threadably engaged with back plate 36. In other embodiments, venturi tube 58 may be permanently attached to back plate 36 via welding, soldering, brazing, or other suitable bonding mechanism. Gas conduit 18 and gas spud 40 containing aperture 56 may be connected to venturi tube 58 such that an air opening 60 may be present. The flow of fuel from aperture 56 into the venturi tube 58 may aspirate air into the venturi tube 58 through air opening 60. The air and fuel may mix within the venturi tube 58 and enter combustion chamber 48 through an aperture or apertures 64 within the venturi nozzle 62. The naturally aspirated premix burner arrangement may be configured to function with or without air holes 38 in back plate 36. In some embodiments, the additional apertures 38 in the back plate 36 may be removed.

While not expressly shown, it is contemplated that torch tip 14 may utilize a combination of the naturally aspirated nozzle mix burner arrangement illustrated in FIG. 5 and the naturally aspirated premix burner arrangement illustrated in FIG. 5A, which may be considered a naturally aspirated partial premix burner configuration. For example, in some embodiments, the torch tip 14 may include a venturi tube 58 for partially aspirating air as well as a back plate 36 with additional apertures 38 for providing additional air to the combustion chamber.

Referring once again to FIG. 5, the region defined by back plate 36, flame locking plate 44, and the walls of torch tip 14 may define a combustion chamber 48. Torch tip 14 may have a first cross-sectional area in the combustion chamber 48, represented by diameter $D_1$, and a second cross-sectional area extending from the flame locking plate 44 to the second end 17, represented by diameter $D_2$. In some embodiments, the second cross-section area may be larger than the first cross-sectional are such that second end 17 has a larger cross-sectional area than first end 15. While torch tip 14 is illustrated and described as having a circular cross-section, it is contemplated that torch tip 14 may have any cross-sectional shape as desired, such as, but not limited to, square, rectangular, oval, polygonal, etc.

Torch tip 14 may further include a flame locking ring 44 positioned against a rim 45 created by the transition from the first diameter D1 to the second diameter D2. Flame locking ring 44 may be positioned a distance inward from second end 17. In some instances, flame locking ring 44 may be attached to torch tip 14 by any suitable way, such as, but not limited to welding, soldering, brazing, etc. Alternatively, or in addition, flame locking ring 44 may be press-fit within the hollow body of the torch tip 14. In other embodiments, flame locking ring 44 may form a unitary structure with torch tip body 14. Flame locking ring 44 may include a primary aperture 46 extending therethrough. In some embodiments, flame locking ring 44 may further include one or more supplemental apertures 50. Supplemental apertures 50 may, for example, create eddies within ignition combustion chamber 48 and beyond. The eddies may in turn help mix the air and gas, and help stabilize the flame. Flame locking ring 44 may include any number of supplemental apertures 50, for example, one, two, four, eight, or more. Supplemental apertures 50 may be positioned around a perimeter of the flame locking ring 44 at equal intervals or alternatively, may be positioned at any spacing as desired. In some instances, supplemental apertures 50 may each have a smaller cross-section than primary aperture 46. In some cases, the supplemental apertures 50 are omitted.

Figure 7:
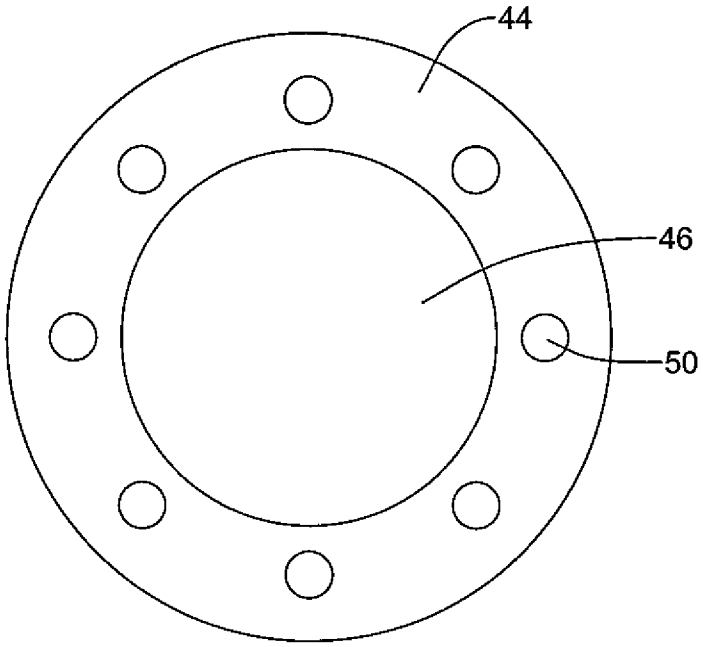
FIG. 7 is a cross-section of an illustrative flame locking plate.

FIG. 7 shows an end view of an illustrative flame locking ring 44 removed from the torch tip 14. In the illustrative embodiment, flame locking ring 44 may include a primary aperture 46 extending therethrough. In some embodiments, flame locking ring 44 may further include one or more supplemental apertures 50. Flame locking ring 44 may include any number of supplemental apertures 50, for example, one, two, four, eight, or more. Supplemental apertures 50 may be positioned around a perimeter of the flame locking ring 44 at equal intervals or alternatively, may be positioned at any spacing as desired.

Figure 8:
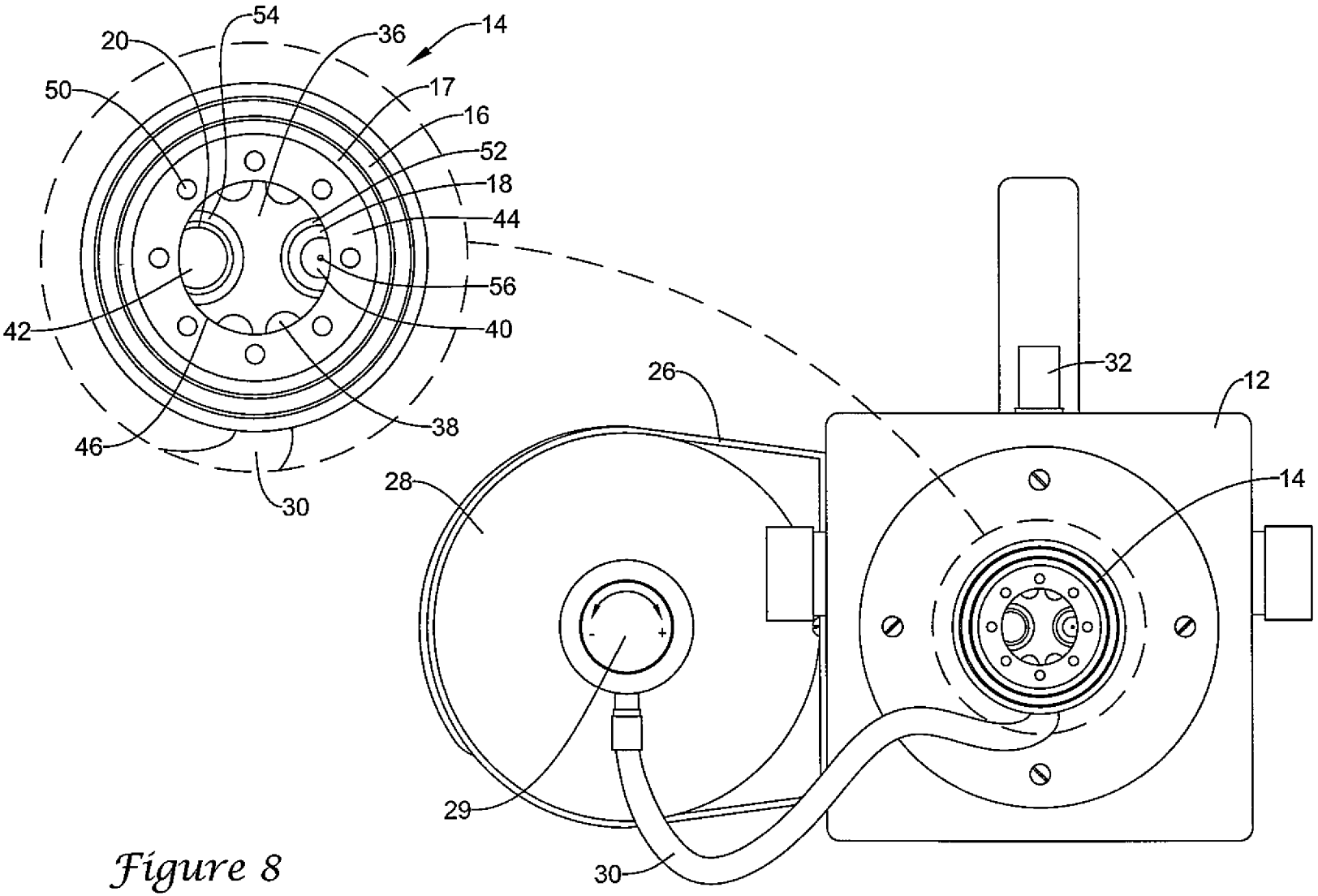
FIG. 8 is an end view of the illustrative hand held torch of FIG. 1 taken along line 8-8.

FIG. 8 shows an end view of the illustrative hand held torch 10 of FIG. 1 taken along line 8-8, with the tip area enlarged for greater detail. When the hand held torch 10 is viewed from the torch tip 14 end, one may see the flame locking plate 44 is positioned in front of back plate 36. As previously discussed, fuel spud 40 may include an aperture 56 defined therethrough to allow fuel to enter the combustion chamber 48 of fuel tip 14. Aperture 56 may be sized to allow a desired amount of fuel to exit fuel tube 18 into combustion chamber 48 to create a desired air to fuel ratio.

Figure 9:
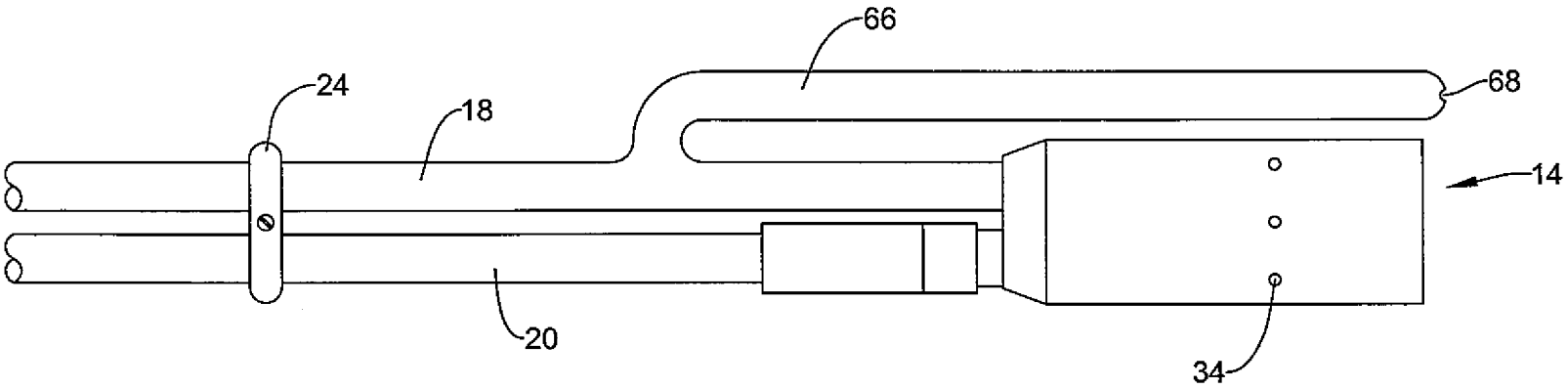
FIG. 9 is a side view of alternative configuration of the torch tip region of the illustrative hand held torch of FIG. 1.

FIG. 9 shows an alternative configuration of the torch tip 14 region of portable hand held torch 10. In some embodiments, fuel conduit 18 may include one or more secondary fuel conduits 66. Secondary fuel conduit 66 may provide additional fuel through aperture 68 to the flame emitted from torch tip 14 to create a more voluminous flame. While the secondary fuel conduit 66 is illustrated as having one aperture 68, it is contemplated the secondary fuel conduit may have any number of apertures 68 desired, for example, but not limited to, one, two, three, four, or more apertures oriented ion various and multiple positions relative to torch tip 14. The flame fed by the secondary fuel conduit 66 may be in fluid communication with and sometimes sustained by the combustion chamber 48. As such, the emitted flame may be fed by fuel and air in excess of that which is consumed within and exited from the combustion chamber 48. While not explicitly shown, it is contemplated that a secondary fuel source may be used to generate an emitted flame. For example, torch tip 14 may not be connected to torch body 12, but instead may be configured to be connected to a secondary fuel source at a remote location such that the torch tip 14 may be considered a portable combustion chamber.

Those skilled in the art will recognize that the present invention may be manifested in a variety of forms other than the specific embodiments described and contemplated herein. Accordingly, departure in form and detail may be made without departing from the scope and spirit of the present invention as described in the appended claims.

What is claimed is:

1. A torch tip for use in manually igniting a standing pilot flame or a main burner flame of combustion equipment, the torch tip comprising:

a hollow tip body with a first end and a second opposing end, the hollow tip body defining an internal volume that extends to the second end of the hollow tip body;

a back plate positioned adjacent to the first end of the hollow tip body, across the diameter of the hollow tip body;

a flame locking plate positioned in the internal volume of the hollow tip body and spaced a distance away from the back plate toward the second end of the hollow tip body, the flame locking plate having a primary aperture extending therethrough;

the hollow tip body, back plate and the flame locking plate generally defining an initial combustion chamber wherein the back plate includes air holes for allowing air to pass into the initial combustion chamber;

the flame locking plate positioned inward from the second end defining a second combustion chamber;

a fuel source conduit delivering a fuel directly to the initial combustion chamber, the fuel source conduit secured relative to the hollow tip body and extending into the initial combustion chamber; and a high energy capacitive discharge igniter extending into the initial combustion chamber and creating a reliable ignition spark in the initial combustion chamber upon demand, the high energy capacitive discharge igniter secured relative to the hollow tip body and extending into the initial combustion chamber and held in a fixed position relative to the fuel source conduit wherein the fuel source conduit extends into the initial combustion chamber a first distance from the first end of the hollow tip body, and the high energy capacitive discharge igniter extends into the initial combustion chamber a second distance from the first end of the hollow tip body, wherein the second distance is larger than the first distance.

2. The torch tip of claim 1, wherein the back plate includes a first hole for receiving the fuel source conduit and a second hole for receiving the high energy capacitive discharge igniter.

3. The torch tip of claim 1, wherein the flame locking plate has one or more supplemental apertures, each positioned around the perimeter of the primary aperture in the flame locking plate.

4. The torch tip of claim 3, wherein the one or more supplemental apertures are smaller than the primary aperture.

5. The torch tip of claim 1, wherein the internal volume defined by the hollow tip body between the flame locking plate and the second end of the hollow tip body has a cross-sectional area that is greater than the cross-sectional area between the flame locking plate and the back plate.

6. The torch tip of claim 1, wherein the hollow tip body includes one or more apertures that extend from the internal volume of the hollow tip body to external of the hollow tip body, where the one or more apertures are positioned between the flame locking plate and the second end of the hollow tip body.

7. The torch tip of claim 1, wherein the fuel is provided to the fuel source conduit at a pressure of between 0.5 and 25 psig.

8. The torch tip of claim 1, wherein the high energy capacitive discharge igniter is electrically powered by an electric power source.

9. A portable hand held torch comprising:

a torch body having a torch tip, wherein when the torch is lit, the torch tip emitting a flame;

the torch tip including a hollow tip body with a first end and a second opposing end, the hollow tip body defining an internal volume that extends to the second end of the hollow tip body;

a back plate positioned adjacent to the first end of the hollow tip body, across the diameter of the hollow tip body;

a flame locking plate positioned in the internal volume of the hollow tip body and spaced a distance away from the back plate toward the second end of the tip body defining a second combustion chamber, the flame locking plate having a primary aperture extending therethrough;

the hollow tip body, back plate and the flame locking plate generally defining an initial combustion chamber, wherein the back plate includes air holes for allowing air to pass into the initial combustion chamber;

a fuel source conduit for delivering a fuel to the initial combustion chamber, the fuel source conduit secured relative to the hollow tip body and extending into the initial combustion chamber a first distance;

a high energy capacitive discharge igniter for creating a reliable ignition spark upon demand, the high energy igniter secured relative to the hollow tip body and extending into the initial combustion chamber a second distance and held in a fixed position relative to the fuel source conduit wherein the second distance is larger than the first distance;

a handle coupled to the torch body for holding the portable hand held torch;

an ignition button or switch coupled to the high energy igniter for selectively activating the high energy igniter; and a fuel source coupled to the fuel source conduit, the fuel source secured relative to the torch body.

10. The portable hand held torch of claim 9, wherein the high energy igniter is a high energy capacitive discharge igniter.

11. The portable hand held torch of claim 9, wherein the back plate includes a first hole for receiving the fuel source conduit and a second hole for receiving the high energy igniter.

* * * * *